US005291932A

United States Patent [19]

Kraeutler

[11] Patent Number: 5,291,932

[45] Date of Patent: Mar. 8, 1994

[54] GOODS-HANDLING DOOR HAVING A DRAFT-PROOF RAISABLE CURTAIN

[75] Inventor: Bernard Kraeutler, Dunieres, France

[73] Assignee: Nergeco, Dunieres, France

[21] Appl. No.: 974,290

[22] Filed: Nov. 10, 1992

[30] Foreign Application Priority Data

Nov. 12, 1991 [FR] France ..... 91 13860

[51] Int. Cl.[5] ..... E06B 3/94

[52] U.S. Cl. ..... 160/84.1 R; 160/264; 160/271

[58] Field of Search ..... 160/84.1, 268.1, 270, 160/271, 272, 273.1, 274, 264

[56] References Cited

U.S. PATENT DOCUMENTS

| | | | |
|---|---|---|---|
| 3,231,006 | 1/1966 | Fisher et al. | 160/272 X |
| 4,357,978 | 11/1982 | Keller et al. | 160/271 X |
| 4,408,650 | 10/1983 | Verch | 160/272 X |
| 4,586,552 | 5/1986 | Labelle . | |
| 4,649,981 | 3/1987 | Bibeau . | |
| 4,665,964 | 5/1987 | Zommers | 160/84.1 |
| 4,776,379 | 10/1988 | Kraeutler | 160/84.1 |
| 5,056,579 | 10/1991 | Krafutler | 160/271 |
| 5,117,892 | 6/1992 | Murray | 160/272 X |

FOREIGN PATENT DOCUMENTS 1578097 8/1969 France .

*Primary Examiner*—David M. Purol

*Attorney, Agent, or Firm*—Sughrue, Mion, Zinn, Macpeak & Seas

[57] ABSTRACT

A goods-handling door having a raisable curtain for closing a door-bay, the door including two rigid side uprights disposed on either side of the door-bay, each upright including a slideway, the door further including a curtain disposed between the uprights, the vertical edges of the curtain sliding in respective ones of the slideways, each upright including a rigid web that faces said door-bay, each slideway including a vertical slot formed through said rigid web, said vertical slot being delimited by two edges, wherein each slideway further includes a flexible draft-proofing cloth interconnecting its two edges over substantially the entire height of the slot, thereby delimiting a vertical pocket on its side opposite from the door-bay, which pocket is designed to receive an edge of the curtain, said edge bearing flexibly against the bottom of the pocket, which bottom has sufficient clearance to absorb movements and deformations of the edge of the curtain.

8 Claims, 3 Drawing Sheets

GOODS-HANDLING DOOR HAVING A DRAFT-PROOF RAISABLE CURTAIN

The present invention relates to a goods-handling door having a draft-proof raisable curtain.

BACKGROUND OF THE INVENTION

Such doors are used in industrial or commercial premises, factories, warehouses, garages, stores, etc. and they comprise a movable curtain that can be raised or lowered so as to open or close a door-bay through a wall. Such a door comprises a frame constituted by two side uprights each forming or including a slideway for an edge of the curtain, and usually associated with a top horizontal cross-member that interconnects the top portions of the uprights.

The present invention relates more particularly to a device that provides draft-proofing between the edge of the curtain and the corresponding slideway, that enables the curtain to move quietly, that facilitates sliding, and that withstands wind effectively. The curtain may be constituted by a flexible cloth made of fabric or of plastic, and optionally reinforced by reinforcing bars, the curtain being capable of being folded up or rolled up at the top of the door. The curtain may also be constituted by rigid panels that are hinged to one another. In that case, it will be understood that the device of the invention may be applied in circumstances where the panels are displaced in a direction other than the vertical.

An object of the invention is to obtain good draft-proofing from the door when it is in its closed position. Another object of the invention is to obtain operation of the door that is quiet, with the edges of the curtain sliding easily in the slideways.

SUMMARY OF THE INVENTION

To this end, the present invention provides a raisable-curtain goods-handling door including two rigid side uprights disposed on either side of the opening of a door-bay, each upright forming or including a slideway, and a curtain disposed between the uprights, the vertical edges of the curtain sliding in respective slideways, wherein each slideway includes a vertical slot formed in the rigid web of the upright that faces towards the center of the curtain, each slot being delimited by two edges, and a flexible draft-proofing cloth interconnecting the two edges over substantially the entire height of the slot, thereby defining a vertical pocket extending away from the center of the curtain and designed to receive an edge of the curtain, said edge bearing flexibly against the bottom of the pocket, said pocket having sufficient clearance to absorb the movements and deformations of the edge of the curtain.

U.S. Pat. No. 4,649,981 describes an insulating curtain whose edges slide in side slideways, with each slideway being formed by a flexible longitudinal pocket disposed in a rigid upright, the edges of the pocket being fixed to the edges of a longitudinal slot for receiving the edge of the curtain. In that proposal, the bottom of the pocket is fixed to the rigid web of the upright. The purpose of the device described is to hold the edges of the curtain in the slideways when the curtain is exposed to wind or any other force that acts in a direction perpendicular to the plane of the curtain. Draft-proofing may be obtained by the edge of the curtain sliding between two flexible strips applied to the two faces of the curtain.

The device described is fragile and cannot be applied to goods-handling doors. Operation of the device is unreliable since the curtain necessarily leaves the slideways where it is rolled up above the door, and it is not clear that it will return properly into the slideways on being lowered. In any event, the technical problem is not the same.

In an advantageous embodiment, the flexible draft-proofing cloth is provided on its two edges with rectilinear rods, and the rods are fixed to the edges of the slideway. In particular, the cloth may be a flattened tube, with the rods being received therein.

In accordance with the invention, the edges of the slideway may be fitted with plastic section members that facilitate sliding of the edges of the curtain. Advantageously, the section members are resiliently snap-fastened to the edges of the slideway. Preferably, each section member includes a longitudinal housing for receiving a corresponding rod.

BRIEF DESCRIPTION OF THE DRAWINGS

An embodiment of the invention is described by way of example with reference to the accompanying drawings, in which.

DETAILED DESCRIPTION

Figure 1:
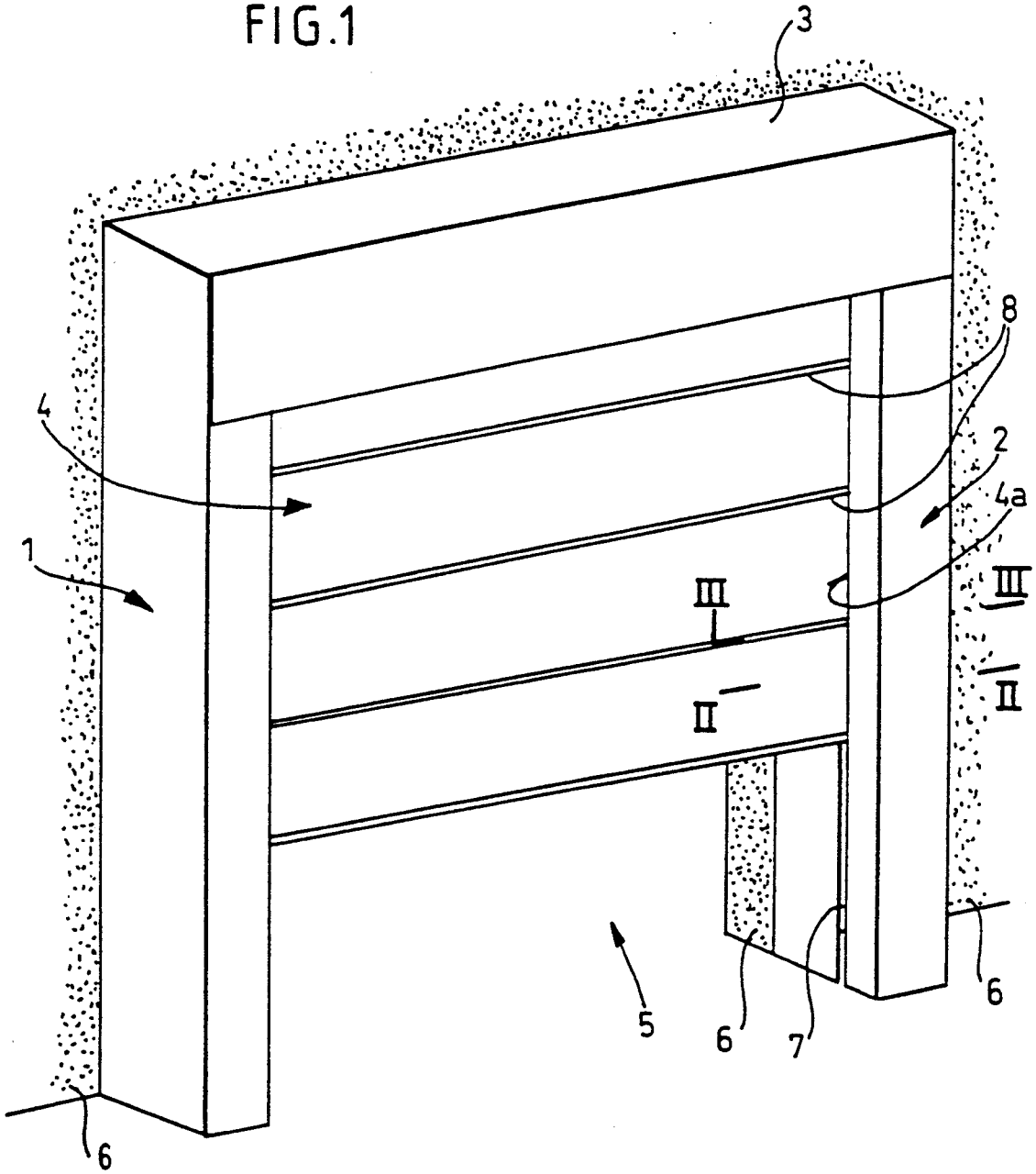
FIG. 1 is a diagrammatic perspective view of a door to which the invention may be applied.

FIG. 1 shows an example of a goods-handling door having a raisable curtain and to which the invention may be applied (the invention is not shown in this figure). The door comprises two side uprights 1 and 2 that are interconnected at their tops by a cross-member 3. A flexible curtain 4 is capable of closing or opening a door-bay 5 formed through a wall 6, by being lowered or by being raised. The edges 4*a* of the curtain 4 slide in slideways 7 formed in the side uprights. The curtain may be reinforced by reinforcing bars 8, in which case the ends of the bars may penetrate into the slideways 7. The invention is also applicable to cases where there are no reinforcing bars, or to cases where there are reinforcing bars, but their ends do not penetrate into the slideways 7. The flexible curtain 4 can be wound onto a shaft situated, for example, inside the cross-member 3, or alternatively, it may be folded up concertina-like inside the top portion of the door. The invention is also applicable to doors that include a curtain made up of rigid panels that are juxtaposed or that are hinged to one another, with the side edges thereof sliding in the slideways 7.

Figure 2:
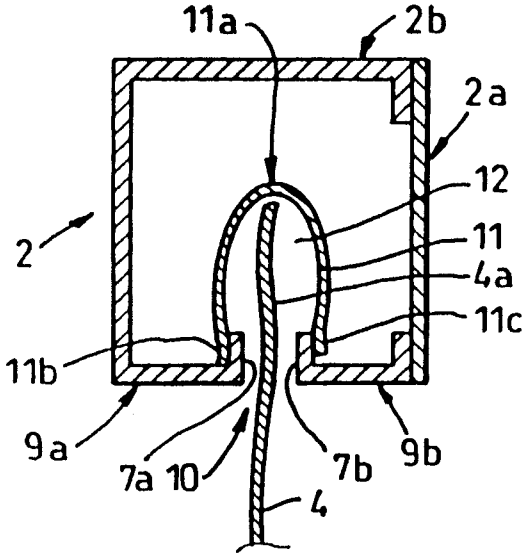
FIG. 2 is a section view on plane II—II of FIG. 1.

The section of FIG. 2 shows a rigid upright 2 which may be made of metal or of some other material, e.g. wood or plastic. Each upright 1, 2 includes a slot 7 that forms a part of the slideway, which slot is formed in a web 9 of the upright 2 that faces the middle of the door, such that the slot splits said web into two portions 9*a* and 9*b*. The edges of the web 9 may be folded inwards to form edges 7*a* and 7*b* for the slideway, as shown. The slideway may be formed as a single piece, but it is often advantageous for one of its sides to be removable so as to facilitate manufacture and maintenance. To the edges 7*a* and 7*b* of the slideway are fixed the edges 11*b* and 11*c* of a cloth in the form of a strip 11 of strong plastified fabric for forming a vertical pocket 12. The edge 4a of the curtain 4 is engaged in said pocket such that when the door is in its closed position said edge bears resiliently against the bottom 11a of the pocket. The edge of the curtain is thus made draft-proof when the door is closed, and flexible and quiet operation of the door is obtained while it is moving. The cloth thus provides thermal insulation and limits the effects of frosting.

It is essential for the bottom 11a of the pocket to be free to move without hindrance away from the slot 7 in the slideway, and thus it is essential for it to be at sufficient distance from the opposite web 2b of the upright 2 (or alternatively for there to be no web of the upright in this direction).

The edges of the flexible cloth 11 may be fixed to the edges 7a and 7b of the slot 7 by any suitable means. A practical and advantageous example of such means is described below with reference to FIG. 3.

Figure 3:
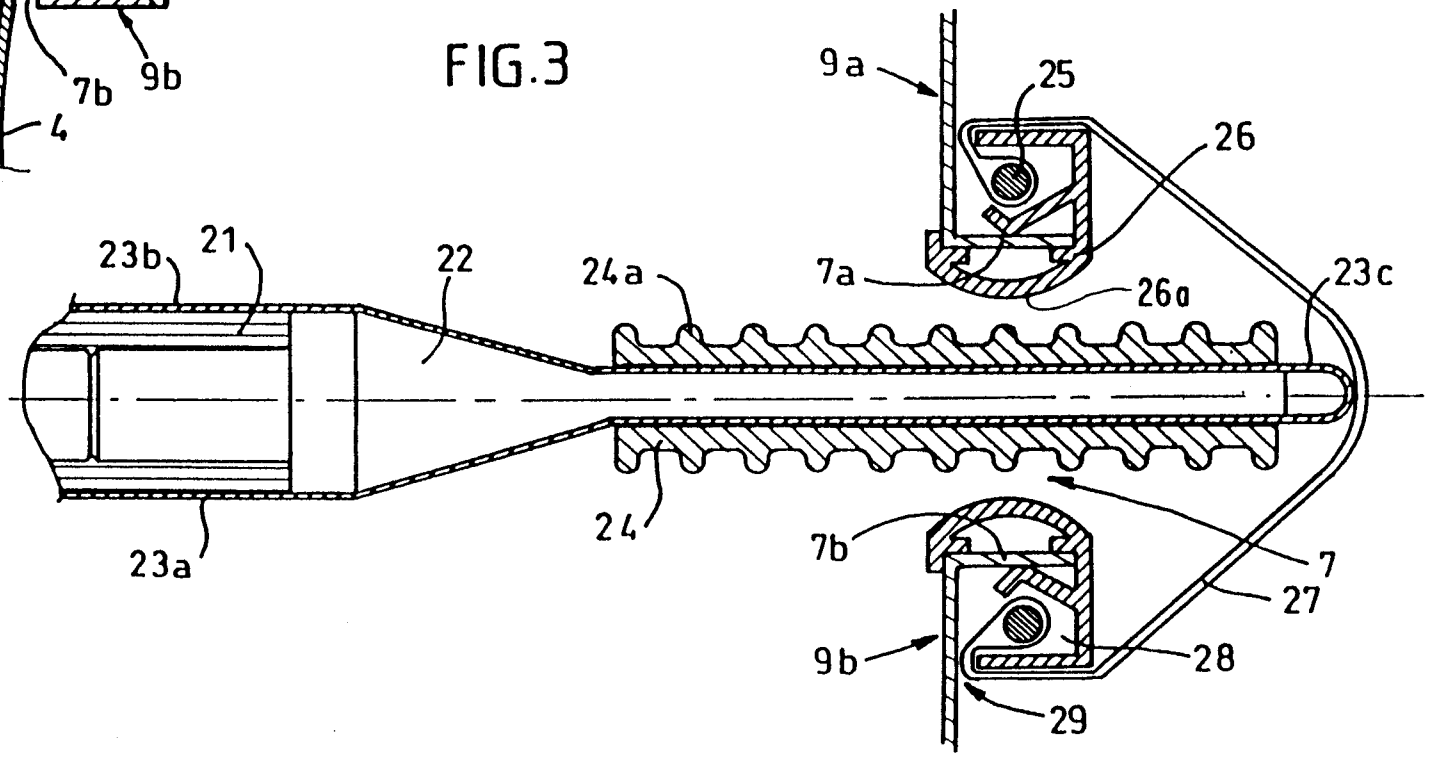
FIG. 3 is a section view on plane III—III of FIG. 1.
Figure 6:
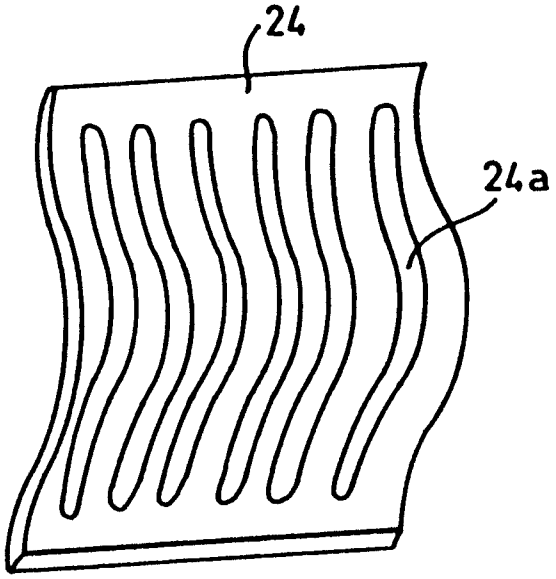
FIGS. 4, 5, and 6 are perspective views showing details of an item shown in FIG. 3.

The section of FIG. 3 is level with a reinforcing bar of the curtain, i.e. the curtain is one that has reinforcing bars. The figure shows only the folded edges 7a and 7b on either side of the slot 7, together with the edges 9a and 9b of the web 9 of the upright 2.

In order to facilitate sliding, sliding section members 26 made of plastic are snapped into place and secured to the edges 7a and 7b of the slideway. Each of these section members presents a rounded face 26a in the slot of the slideway, thereby enhancing sliding and avoiding any danger of catching. In addition, the draft-proofing cloth may be fixed in simple manner to these section members. To do this, each section member has a longitudinally extending housing 28 having a narrow access passage 29, while each edge of the cloth is provided with a rectilinear rod 25 (made of wood or plastic) of diameter greater than the width of the narrow passage, but nevertheless enabling it to be inserted into the housing 28 by resiliently deforming at least a portion of said section member.

The section of FIG. 3 shows a simple manner in which the rods 25 can be fixed to the cloth. The cloth is merely constituted by a flat tube, and the two rods are merely engaged therein.

Figure 4:
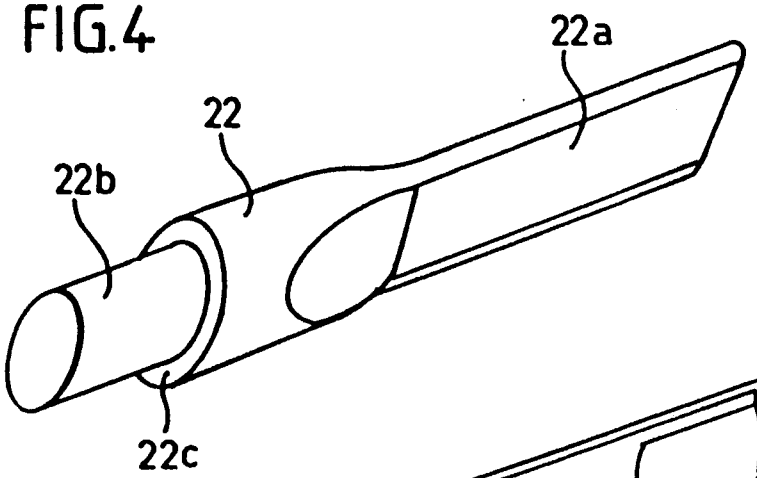

In this figure, the section is made on a horizontal plane that includes the axis of a reinforcing bar. In this embodiment, the bar comprises a flexible tube 21, e.g. made of metal or of reinforced plastic, which is slightly shorter than the gap between the sideways. An endpiece 22 (see FIG. 4) is fitted in the flexible tube so as to extend it with a fin portion 22a that lies generally in a vertical plane. The fin portion 22a is designed to move in the slideway, and it is of reduced thickness, being of a thickness comparable to that of the curtain. For example, the tube may have a diameter of 3 cm, while the fin portion is half a centimeter thick. The endpiece may have a reduced section portion at its other end 22b associated with a shoulder 22c so as to obtain a connection that is well defined and accurate. The connection may be a force-fit, or it may be glued, etc. The endpiece may be made of a very stiff plastic so as to hold the curtain in position in the slideways when the curtain is subjected to wind, while nevertheless being sufficiently flexible to fold and escape from the slideway when the curtain is subjected to an abnormal force, e.g. should a vehicle run into the curtain.

Figure 5:
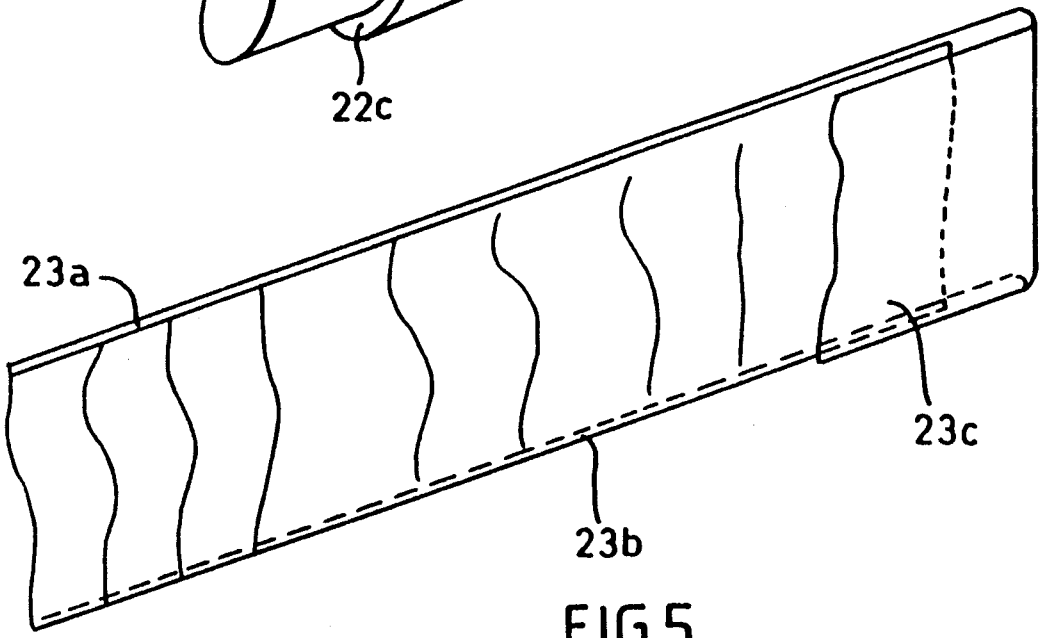

As is well known in the art, the curtain may be lined on both faces over a reinforcing bar with strips of plastic or plasticized fabric 23a and 23b (see also FIG. 5) which are extended to the end of the endpiece, so as to enclose it completely by one of the strips folding over the other at 23c. The strips are welded to each other above and below the bar, thereby forming a sheath for the bar.

Finally, as is well known in the art (see patent FR 91-02712), the portion of the endpiece situated in the slideway between the rounded faces 26a thereof may itself be provided on its faces that face the two rounded faces 26a with sliding skids 24, that are advantageously provided with ribs 24a that extend vertically. The skids reduce wear, facilitate sliding, and oppose axial movement of the reinforcing bar.

I claim:

1. A goods-handling door having a raisable curtain for closing a door-bay, the door including:

two rigid side uprights disposed on either side of the door-bay, each upright including a slideway, the door further including a curtain disposed between the uprights, the vertical edges of the curtain sliding in respective ones of the slideways, each upright including a rigid web that faces said door-bay, each slideway including a vertical slot formed through said rigid web, said vertical slot being delimited by two edges, wherein each slideway further includes a flexible draft-proofing cloth interconnecting said two edges of said vertical slot over substantially the entire height of the vertical slot, thereby delimiting a vertical pocket on a side of said each slideway opposite the door-bay, which vertical pocket is designed to receive one of said vertical edges of the curtain, said one of said vertical edges bearing flexibly against a bottom of the vertical pocket, which said bottom has sufficient clearance to absorb movements and deformations of the one of said vertical edges of the curtain.

2. The door according to claim 1, wherein the flexible draft-proofing cloth is provided along said two edges of said vertical slot with rectilinear rods fixed to the vertical edges of said vertical slot.

3. The door according to claim 2, wherein the flexible draft-proofing cloth defines a flattened tube, and wherein said rods are disposed inside said tube.

4. The door according to claim 1, wherein each of said slideways further comprises plastic section members connected to the vertical edges of said slot to facilitate sliding of one of said vertical edges of the curtain.

5. The door according to claim 4, wherein the section members resiliently snap-fastened onto the corresponding edges of said each sideway.

6. The door according to claim 2, wherein the vertical edges of said each slideway are provided with respective plastic section members that facilitate sliding of one of said vertical edges of the curtain, and wherein each section member includes a longitudinal housing for receiving a corresponding one of said rods.

7. The door according to claim 1, wherein the curtain is reinforced by at least one reinforcing bar, wherein said at least one reinforcing bar is shorter than the distance between the slideways and wherein said at least one reinforcing bar is extended at both ends by endpieces having a selected one of a smaller or flattened section suitable for engagement in the slideways.

8. The door according to claim 7, wherein said at least one bar is a tube having reduced-diameter portions of the endpieces received in the ends of said tube.

* * * * *